US009226526B2

(12) United States Patent
Liu

(10) Patent No.: US 9,226,526 B2
(45) Date of Patent: Jan. 5, 2016

(54) ELECTRONIC CIGARETTE DEVICE, ELECTRONIC CIGARETTE AND ATOMIZING DEVICE THEREOF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 252 days.

(21) Appl. No.: 13/994,711

(22) PCT Filed: Nov. 12, 2012

(86) PCT No.: PCT/CN2012/084444

§ 371 (c)(1),
(2) Date: Jun. 15, 2013

(87) PCT Pub. No.: WO2014/071625

PCT Pub. Date: May 15, 2014

(65) Prior Publication Data

US 2014/0130797 A1 May 15, 2014

(51) Int. Cl.
*A61M 11/00* (2006.01)
*A24F 47/00* (2006.01)

(52) U.S. Cl.
CPC ..... *A24F 47/008* (2013.01)

(58) Field of Classification Search
CPC ..... A24F 47/008; A24F 47/002
USPC ..... 128/202.21; 131/329, 194
See application file for complete search history.

(56) References Cited

U.S. PATENT DOCUMENTS

| | | | | |
|---|---|---|---|---|
| 2009/0095311 | A1* | 4/2009 | Han | 131/194 |
| 2013/0192622 | A1* | 8/2013 | Tucker et al. | 131/329 |
| 2013/0340778 | A1* | 12/2013 | Liu | 131/329 |
| 2014/0007891 | A1* | 1/2014 | Liu | 131/329 |
| 2014/0311503 | A1* | 10/2014 | Liu | 131/329 |
| 2014/0318558 | A1* | 10/2014 | Liu | 131/329 |

* cited by examiner

*Primary Examiner* — Steven Douglas
(74) *Attorney, Agent, or Firm* — Cheng-Ju Chiang

(57) ABSTRACT

An electronic cigarette atomizing device is provided. An atomizer thereof has an atomizing rod and an electric heating filament wrapped around the atomizing rod, the atomizing rod is made of a non-glass fiber material, and includes a base and at least two wrapping bars spaced apart from each other and axially disposed on outer sides of the base. The atomizing rod axially defines an air guiding hole through the base and connected between the at least two wrapping bars for communicating with an inhaling air path. The atomizing rod is made of the non-glass fiber material, an electric heating filament directly abutted against a liquid storing portion which efficiently prevents people from inhaling harmful glass fiber particles.

16 Claims, 7 Drawing Sheets

ELECTRONIC CIGARETTE DEVICE, ELECTRONIC CIGARETTE AND ATOMIZING DEVICE THEREOF

CROSS REFERENCE TO RELATED APPLICATIONS

The present application is a 35 U.S.C. §371 National Phase conversion of International (PCT) Patent Application No. PCT/CN2012/084444, filed on Nov. 12, 2012, the disclosure of which is incorporated by reference herein. The PCT International Patent Application was filed in Chinese.

BACKGROUND OF THE INVENTION

1. Field of the Invention

The present invention relates to an electronic cigarette and a cigarette case, and particularly to an electronic cigarette comprising an atomizing device that has an atomizing rod made of non-glass fiber, and an electronic cigarette device thereof.

2. Related Art

A current electronic cigarette has an inhaling rod and a power rod, and the inhaling rod generally includes a suction nozzle and an atomizing device for converting cigarette liquid to smoke. The power rod is generally installed with a battery and a control switch, the battery is used for providing power, and the control switch is used to control the operation of the electronic cigarette.

The atomizing device of a current electronic cigarette has a complex internal structure, and includes an atomizing rod generally made of a glass fiber material for enabling electric heating wires to be wrapped around and for providing a cigarette liquid to the electric heating wires for being heated to generate smoke. Two ends of the atomizing rod are respectively engaged with engaging holes formed on a holding tube to abut against a liquid storing portion of the atomizing device in order for absorbing the cigarette liquid. When people use the electronic cigarettes, glass fiber particles will be generated at the time that the glass fiber material is heated by the electric heating wires, and people will inhale the fine glass fiber particles together with smoke, whereby damaging people's health.

SUMMARY OF THE INVENTION

Accordingly, an object of the present invention is to provide an electronic cigarette atomizing device comprising an atomizing rod made of a non-glass fiber material and directly mounted to a liquid storing portion that is simple in structure and efficiently prevents harmful glass fiber particles to people from being generated.

To achieve the above-mentioned object, the present invention discloses an electronic cigarette atomizing device comprising an atomizing cup having a liquid storing portion, and an atomizer disposed in the atomizing cup and abutting against the liquid storing portion so as to atomize a cigarette liquid. The atomizer comprises an atomizing rod and an electric heating filament wrapped around the atomizing rod. The atomizing rod is made of a non-glass fiber material and a high temperature insulating material, and comprises a base and at least two wrapping bars spaced apart from each other and axially disposed on outer sides of the base for facilitating wrapping of the electric heating filament. The atomizing rod is axially formed with an air guiding hole therein which penetrates the base and opens between the at least two wrapping bars for communicating with an inhaling air path.

According to one aspect of this invention, the at least two wrapping bars extend radially from an axle center of the atomizing rod to form protruding teeth.

According to another aspect of this invention, the air guiding hole passes through the base and extends to an appropriate height relative to the at least two wrapping bars.

According to another aspect of this invention, the at least two wrapping bars are evenly arranged about an axle center of the atomizing rod along a periphery of the base.

According to another aspect of this invention, the at least two wrapping bars are integrally formed with the base.

According to another aspect of this invention, the atomizing rod is axially disposed in the atomizing cup with outer walls of the atomizing rod snug against inner walls of the liquid storing portion.

According to another aspect of this invention, the atomizing cup further comprises an atomizing base for sealingly securing the liquid storing portion, the atomizing base is formed with a positioning peg extending axially towards the air guiding hole of the atomizing rod at an appropriate height for mounting the atomizing rod, a middle of the atomizing base is formed with an air venting channel penetrating the atomizing base in an axial direction thereof, and threading holes are correspondingly formed in the atomizing base to allow the electric heating filament to pass through.

Another object of the present invention is to provide an electronic cigarette, comprising an atomizing device including an atomizing rod made of a non-glass fiber material so as to prevent people from being harmed by inhaling glass fiber particles.

To achieve the above-mentioned object, the present invention comprises a main rod body, one end of the main rod body provided with a suction nozzle, another end thereof installed with a battery, an atomizing device being disposed in the main rod body adjacent to the suction nozzle and electrically connected with the battery. The atomizing device is the electronic cigarette atomizing device as mentioned above.

According to another aspect of this invention, one end of the atomizing device adjacent to the suction nozzle is provided with a sealing ring, and a middle of the sealing ring is formed with a leading hole axially penetrating the sealing ring and communicating with the air guiding hole so as to allow the air path to communicate outside.

According to another aspect of this invention, one end of the atomizing device adjacent to the battery is installed with a connecting module for electrically connecting the atomizing device and the battery, the connecting module comprises a first electrode element designated as a first electrode of the atomizing device, and a second electrode element designated as a second electrode of the atomizing device, and the first and second electrode elements are engaged with each other through an insulating ring.

According to another aspect of this invention, two ends of the electric heating filament are electrically connected to the first and second electrode elements.

According to another aspect of this invention, the electronic cigarette further comprises an atomizing control unit electrically connecting with the battery for controlling power on or power off of the atomizing device, and the atomizing control unit comprises an atomizing control circuit and an atomizing control switch coupling with the atomizing controlling circuit.

According to another aspect of this invention, the atomizing control switch is a transducer switch or a key switch.

According to another aspect of this invention, a light emitting device is disposed on one end of each of the electronic cigarettes far away from the suction nozzle, and the light emitting device comprises a light emitting unit and a light cap located to cover outside the light emitting unit.

Still, another object of the present invention is to provide an electronic cigarette device being stored with at least one electronic cigarette which does not produce glass fiber particles that are harmful to people and flowed together with smoke into human bodies.

To achieve the above-mentioned object, the electronic cigarette device comprises an electronic cigarette case and at least one electronic cigarette accommodated in the electronic cigarette case. The at least one electronic cigarette is the electronic cigarette as described above.

The advantages of the present invention are as follows: because the atomizing rod is made of a non-glass fiber, high-temperature resistant and insulating material, and is directly axially mounted in the liquid storing portion to enable the electric heating filament to directly abut against the liquid storing portion in a simple structure, the electric heating filament is capable of being heated without generating glass fiber particles, whereby enabling a more safe and healthy use.

Embodiments of the present invention are further described below in detail in combination with accompanying drawings.

DESCRIPTION OF THE PREFERRED EMBODIMENTS

As shown in FIG. 1 to FIG. 9, the present invention is to provide an electronic cigarette device, comprising a plurality of electronic cigarettes 100 and an electronic cigarette case 200 for accommodating the plurality of electronic cigarettes 100.

Figure 7:
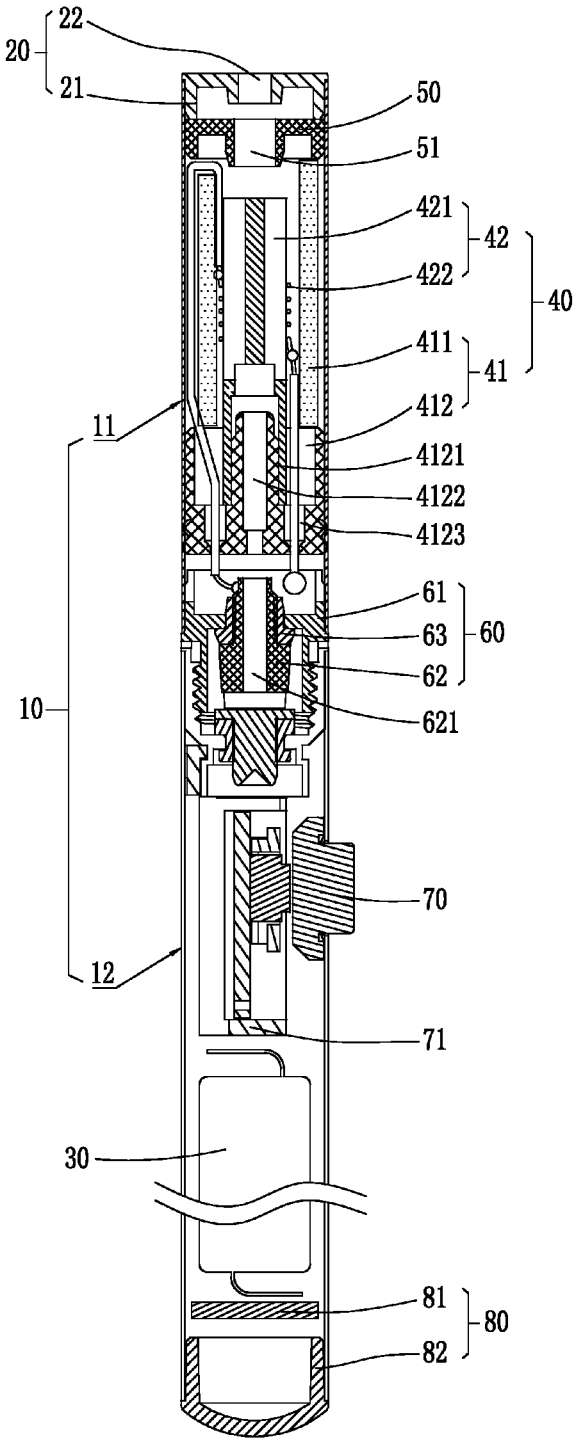
FIG. 7 is a schematic structural view showing a first embodiment of the electronic cigarette of the present invention.
Figure 8:
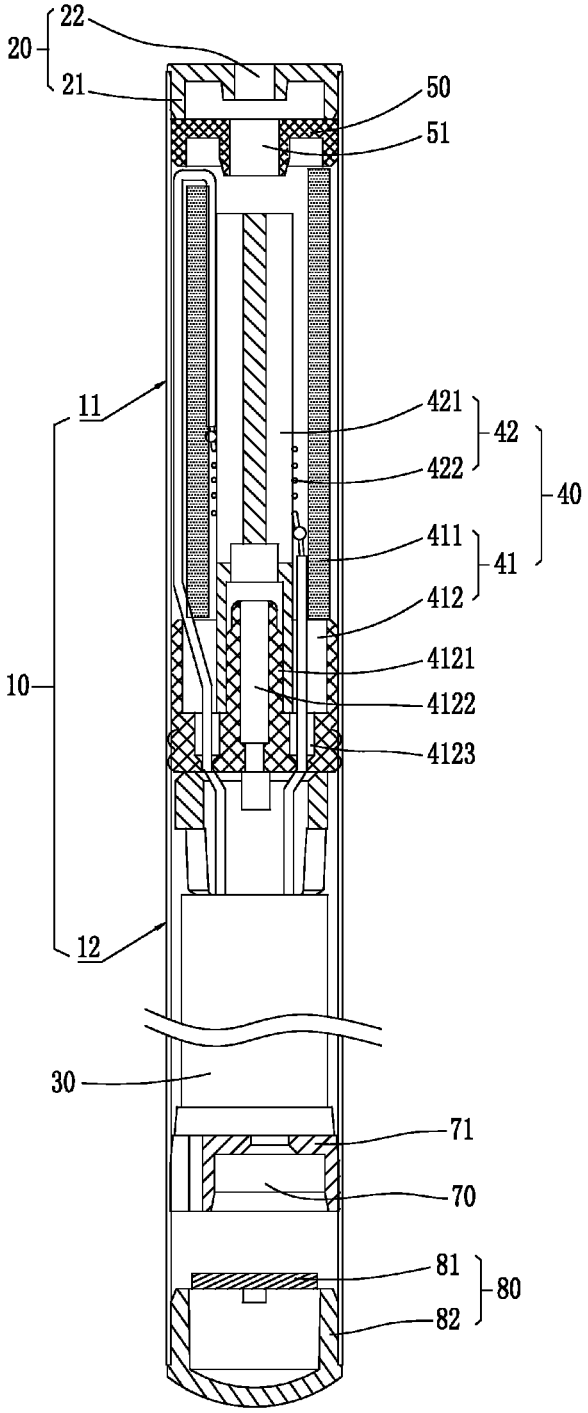
FIG. 8 is a schematic structural view showing a second embodiment of the electronic cigarette of the present invention.

As shown in FIG. 7 and FIG. 8, each of the plurality of electronic cigarettes 100 comprises a main rod body 10. The main rod body 10 has a cylindrical tubular structure being hollow therein to form an accommodating chamber for each internal component. It is understandable that the main rod body 10 is not limited by a cylindrical shape as shown in the present embodiment, and can be any other tubular structure having a hollow chamber. In this embodiment, the main rod body 10 is made of a stainless steel material, a plastic material, or other suitable materials.

One end of the main rod body 10 is provided with a suction nozzle 20, another end far away from the suction nozzle 20 is installed with a battery 30. Therefore, according to internal components of the main rod body 10 and functions thereof, the main rod body 10 can be separated into two parts including an inhaling rod 11 and a power rod 12. That is, the main rod body 10 consists of the inhaling rod 11 and the power rod 12 interconnecting with each other. In this embodiment, the inhaling rod 11 and the power rod 12 are designed to be inseparable as a one-piece structure as shown in FIG. 8. In another aspect, the inhaling rod 11 and the power rod 12 are detachable structure as shown in FIG. 7, both connected in a manner of, such as, engaging connection, inserting connection or screwing connection, etc.

Referring to FIG. 5 to FIG. 8, the main rod body 10 is installed with an atomizing device 40 disposed between the suction nozzle 20 and the battery 30 for atomizing a cigarette liquid to be smoke. The atomizing device 40 is mounted in the inhaling rod 11 and comprises an atomizing cup 41 and an atomizer 42 disposed in the atomizing cup 41.

The atomizing cup 41 comprises a liquid storing portion 411 and an atomizing base 412.

The liquid storing portion 411 has a hollow tubular structure and is axially disposed in the main rod body 10. The liquid storing portion 411 is capable of absorbing and storing liquid as a sponge, and is intended to absorb and store the cigarette liquid which is then to be atomized by the atomizer 42. In this embodiment, the liquid storing portion 411 is made of one of high temperature cotton, chemical fiber cotton, mixture cotton, liquid absorption cotton, sponge cotton, or other materials capable of absorbing and storing liquid.

The atomizing base 412 is corresponding to the main rod body 10 for sealingly securing the liquid storing portion 411 in the main rod body 10, and is disposed on one end of the atomizing device 40 adjacent to the battery 30.

The atomizer 42 is intended to atomize and convert the cigarette liquid to smoke, and comprises an atomizing rod 421 and an electric heating filament 422. The electric heating filament 422 is wrapped around the atomizing rod 421 and is disposed in the atomizing cup 41 over the atomizing rod 421.

Referring to FIG. 1 to FIG. 4, the atomizing rod 421 has a substantially cylindrical structure, and is made of a non-fiber glass material and a high temperature insulating material, such as ceramics or other non-metallic materials that are high temperature resistant, or aluminum being processed with oxidation treatment or other insulating metal materials that are high temperature resistant. In this embodiment, the atomizing rod 421 is preferably made of a ceramic material.

Figure 4:
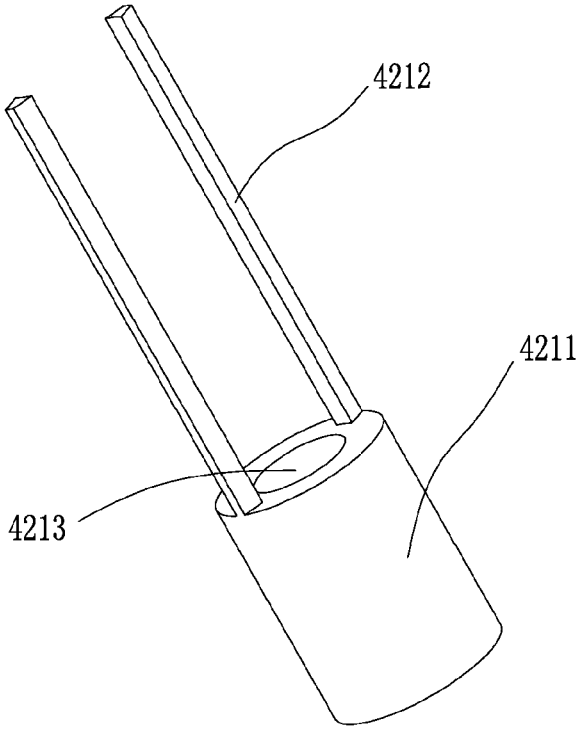
FIG. 4 is a perspective view of the atomizing rod of another embodiment of the present invention.
Figure 5:
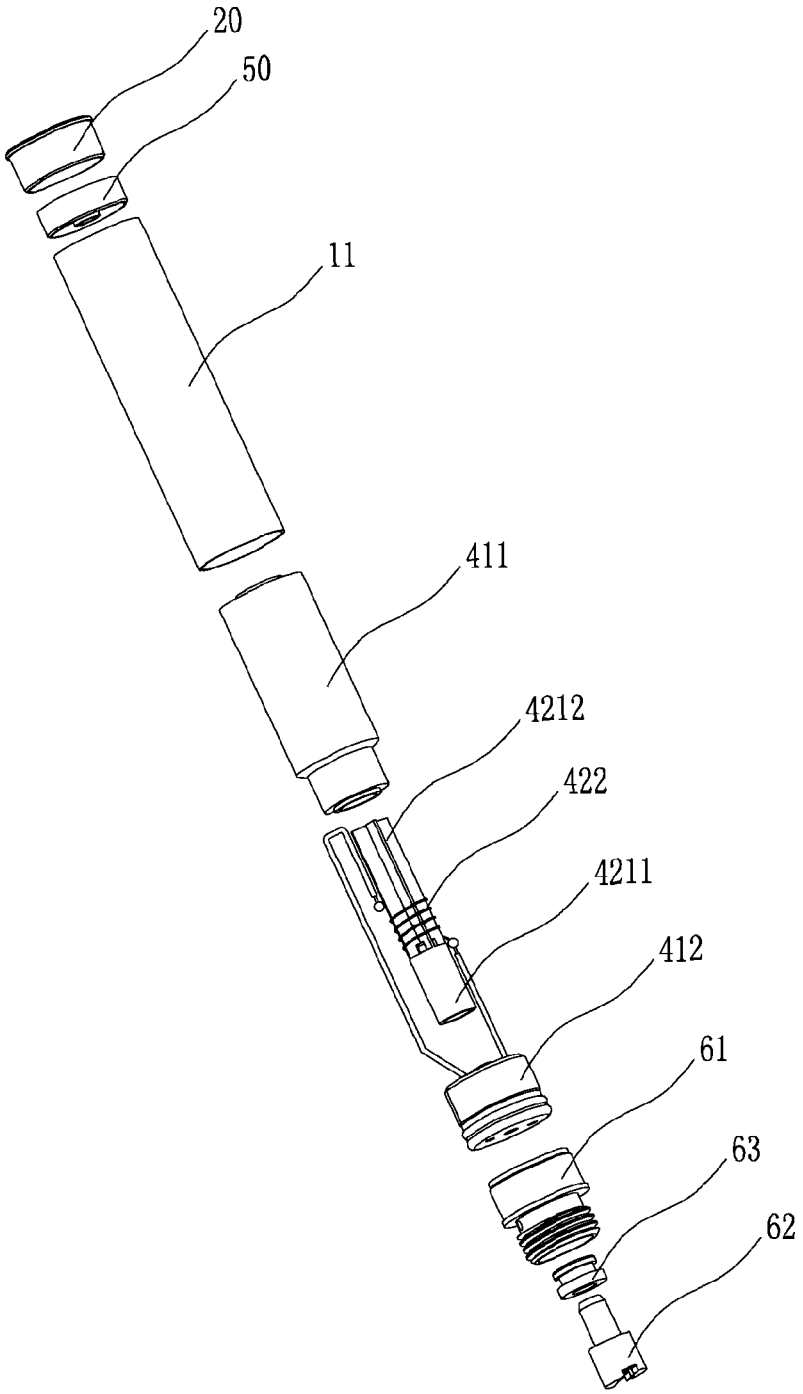
FIG. 5 is a perspective view of an inhaling rod of an electronic cigarette of the present invention.

The atomizing rod 421 comprises a base 4211 and at least two wrapping bars 4212 spaced apart from each other and axially disposed on outer sides of the base 4211 for facilitating wrapping of the electric heating filament 422. The atomizing rod 421 is axially formed with an air guiding hole 4213 therein which penetrates the base 4211 and opens between the wrapping bars 4212 so as to communicate with an inhaling air path. Referring to FIG. 4, an embodiment shown in FIG. 4 discloses the number of the wrapping bars 4212 is two. The two wrapping bars 4212 are correspondingly disposed on the outer side of the base 4211. A middle of the base 4211 is formed with the air guiding hole 4213 which communicates with a gap formed between the two wrapping bars 4212. In practice, middle portions of the two wrapping bars 4212 are capable of being connected to form as a unit, or are separately formed as shown in FIG. 4. Alternatively, the number of the wrapping bars 4212 can be three, four, five or any other appropriate number, and each of the wrapping bars 4212 has a round, polygonal shape, or a combination shape as shown in FIG. 4.

Figure 1:
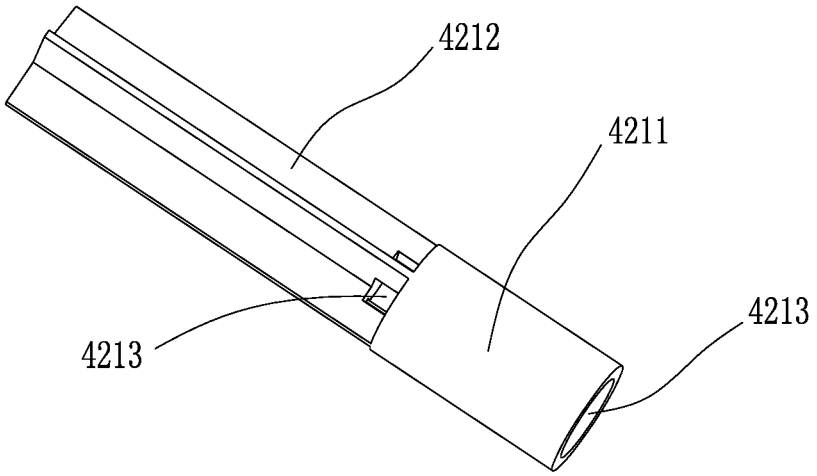
FIG. 1 is a perspective view of an atomizing rod of an embodiment of the present invention.
Figure 2:
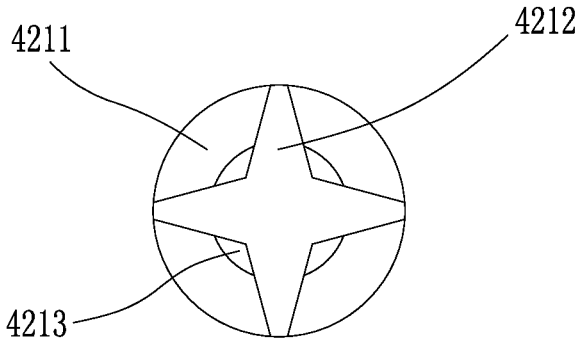
FIG. 2 is a top plan view of the atomizing rod of the present invention.
Figure 3:
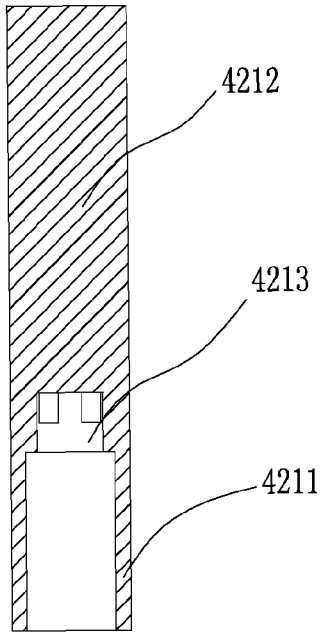
FIG. 3 is a cross-sectional view of the atomizing rod of the present invention.

As a preferable embodiment shown in FIG. 1 to FIG. 3, the number of the wrapping bard 4212 is four, and the four wrapping bars 4212 extend radially from an axle center of the atomizing rod 421 to form protruding teeth, and are evenly arranged about the axle center of the atomizing rod 421 along a periphery of the base 4211, wherein one end of each wrapping bar 4214 adjacent to the axle center of the atomizing rod 421 has a thickness that is larger than a thickness of another end thereof far away from the axle center of the atomizing rod 421, so as to ensure that the electric heating filament 422 is in sufficient contact with the cigarette liquid and make the cigarette liquid being atomized completely. The air guiding hole 4213 passes through the base 4211 in an axial direction thereof and extends to an appropriate height relative to the wrapping bars 4212, so as to cooperate with the gap formed between the two wrapping bars 4212 to realize an axial communication of the air path in the atomizing device 40.

In this embodiment, the wrapping bars 4212 and the base 4211 are integrally formed with each other. Specifically, the wrapping bars 4212 axially extend from an end surface of the base 4211. As one aspect, the wrapping bars 4212 and the base 4211 are separately configured. Number and shapes of the wrapping bars 4212, and ways that the wrapping bars 4212 are arranged in are based on the purpose of facilitating wrapping of the electric heating filament 422 in order to realize the atomization of the cigarette liquid and to allow the air path to communicate outside. Therefore, the wrapping bars 4212 are configured in accordance with practical needs, and are not limited by the embodiments shown in FIG. 1 to FIG. 3.

As shown in FIG. 5 to FIG. 8, the atomizer 45 is axially disposed in the atomizing cup 41. The liquid storing portion 411 is mounted outside of the atomizer 42. The atomizer 42 utilizes outer walls of the atomizing rod 421 to be snug against inner walls of the liquid storing portion 411, and functions as a support frame for the liquid storing portion 411 in order to snugly secure the liquid storing portion 411 in the main rod body 10 as the electric heating filament 422 is abutting against the liquid storing portion 411.

The atomizing base 412 has a substantially cylindrical shape and, with outer walls thereof, is snugly mounted in the maid rod body 10. One end of the atomizing base 412 adjacent to the suction nozzle 20 abuts against the liquid storing portion 411 and the atomizer 42, so as to cooperate with the suction nozzle 20 to sealingly cover the liquid storing portion 411 and the atomizer 42 in the atomizing cup 41. A middle of the atomizing base 412 is formed with a positioning peg 4121 which extends axially at an appropriate height towards the air guiding hole 4213 of the atomizing rod 421 for mounting the atomizing rod 421. The atomizing rod 412 is mounted onto the positioning peg 4121 of the atomizing base 412 through inner walls of the air guiding hole 4213. A middle of the atomizing base 412 is formed with an air venting channel 4122 penetrating the atomizing base 412 in an axial direction thereof and communicating with the air guiding hole 4213, and threading holes 4123 are correspondingly formed on a side wall of the atomizing base 412 to allow the electric heating filament 422 to pass through.

In this embodiment, the atomizing device 40 directly utilizes the main rod body 10 as a cup body of the atomizing cup 41. In this manner, the outer walls of the liquid storing portion 411 are directly snug against inner walls of the main rod body 10. In practice, the atomizing device 40 is capable of being installed with an atomizing cup formed with an individual cup body, whereby the liquid storing portion 411 is snug against the individual cup body of the atomizing cup through the atomizing rod 421, rather than directly abuts against the inner walls of the main rod body 10.

The suction nozzle 20 is mounted to one end of the inhaling rod 11 far away from the battery 30. In this embodiment, the suction nozzle 20 and the main rod body 10 are detachably configured, and the suction nozzle 20 comprises a nozzle cap 21 for mounting one end of the inhaling rod 11. The nozzle cap 21 is axially formed with an inhaling hole 22 communicating with the air guiding hole 4213. As one aspect, the suction nozzle 20 and the main rod body 10 are integrally formed together.

One end of the atomizing device 40 adjacent to the suction nozzle 20 is provided with a sealing ring 50, which cooperates with the atomizing base 412 to sealingly secure the atomizing device 40 in the main rod body 10. A middle of the sealing ring 50 is formed with a leading hole 51 which axially penetrates the sealing ring 50 and communicates with the air guiding hole 4213 and the inhaling hole 22 so as to allow the air path to communicate outside. The sealing ring 50 is utilized to provide a better sealing effect that the atomizing device 40 is sealingly secured between the suction nozzle 20 and the battery 30, whereby to efficiently prevent the cigarette liquid from leaking out of the suction nozzle 20.

The battery 30 is disposed in the power rod 12 for providing electric power for each functional module of the electronic cigarette. The atomizing device 40 electrically connects the battery 30 through a connecting module 60.

Figure 6:
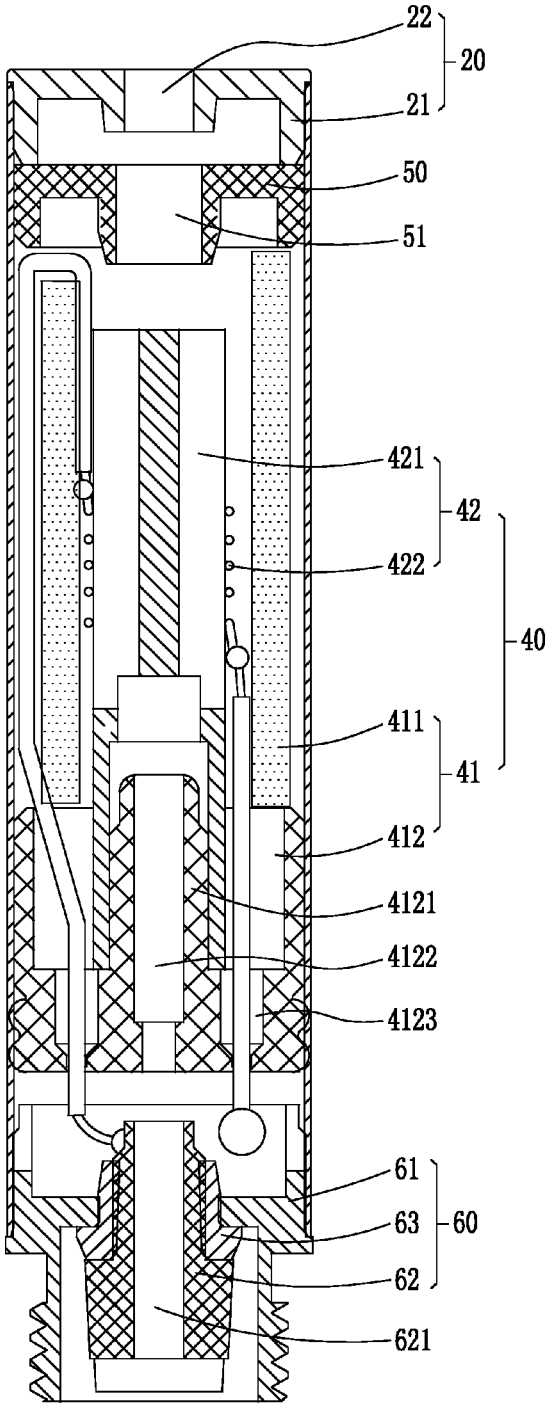
FIG. 6 is a schematic cross-sectional structural view of the present invention.

Referring to FIG. 6 and FIG. 7, the connecting module 60 is connected to one end of the atomizing device 40 adjacent to the battery 30. The connecting module 60 and the suction nozzle 20 are respectively mounted to two ends of the inhaling rod 11 so as to sealingly secure the atomizing device 40 in the inhaling rod 11.

In this embodiment, the connecting module 60 comprises a first electrode element 61 designated as a first electrode of the atomizing device 40, and a second electrode element 62 designated as a second electrode of the atomizing device 40. The first and second electrode elements 61 and 62 are engaged with each other through an insulating ring 63.

The first electrode element 61 has a hollow tubular structure and is snugly mounted to one end of the inhaling rod 11 far away from the suction nozzle 20 and is engaged with the atomizing device 40, wherein a middle of the first electrode element 61 extends radially inwards to form a rib for mounting the second electrode element 62.

The second electrode element 62 is configured to match the first electrode element 61 and is engaged with and insulated from the first electrode element 61 through the insulating ring 63. In this embodiment, the second electrode element 62 also has a hollow tubular structure being centered therein and forming an air inlet hole 621 to allow outside air to flow in the atomizing device 40.

In this embodiment, the first electrode element 61 is designated as a cathode of the atomizing device 40 and is coupled with a cathode of the battery 30. The second electrode element 52 is designated as an anode of the atomizing device 40 and is coupled with an anode of the battery 30. Two ends of the electric heating filament 422 are respectively electrically connected to the first electrode element 51 and the second electrode element 52 through welding, riveting, engaging, or other fixing manners.

Specifically, in this embodiment, the electric heating filament 422 is wrapped around the atomizing rod 421, wherein one end of the electric heating filament 422 is bent to be disposed outside the liquid storing portion 411 and then passes through the corresponding threading hole 4123 of the atomizing base 412 to be terminated by welding to the first electrode element 61, whereby to realize an electrical connection with the cathode of the power pod 12. Another end of the electric heating filament 422 directly passes through the corresponding threading hole 4123 of the atomizing base 412 to be welded to the second electrode element 62 engaged with the first electrode element 61, whereby to realize an electrical connection with the anode of the power rod 12.

As one aspect, when the inhaling rod 11 and the power rod 12 are connected as an integral structure, the connecting module 60 is not necessary to be provided in the inhaling rod 11, and the two ends of the electric heating filament 422 are directly connected to the anode and cathode of the battery 30.

When the inhaling rod 11 and the power rod 12 are connected as a detachable structure, the inhaling rod 11 and the power rod 12 are capable of being connected through the connecting module 60. Furthermore, when the inhaling rod 11 and the power rod 12 are screwed to each other, the power rod 12 and the first electrode element 61 are both formed with corresponding threads to be screwed together.

As shown in FIG. 7 and FIG. 8, one end of the maid rod body 10 far away from the suction nozzle 20 is installed with an atomizing control unit electrically connecting the battery for controlling power on or off of the atomizing device 40. The atomizing control unit comprises an atomizing control circuit and an atomizing control switch 70 coupling with the atomizing controlling circuit. The atomizing control switch 70 is secured in the maid rod body 10 over a fixing base 71.

As an embodiment shown in FIG. 8, the atomizing control switch 70 is exemplified by a transducer switch. Specifically, the transducer switch is a capacitive transducer switch. When a user smokes the electronic cigarette 100, the capacitive transducer switch senses an inhaling air flow, capacitors thereof are changed accordingly so as to control the atomizing control circuit to connect electric power, and thus the electronic cigarette 100 is in an operating state. As one aspect, the transducer switch is alternatively exemplified by an air-flow transducer switch, that is, when a user is inhaling from the suction nozzle 20, a negative pressure is generated in the electronic cigarette 100 and causes the air-flow transducer switch to generate a pulse signal so as to control the atomizing control circuit to connect electric power.

Because the transducer switch is relatively precise in manufacture, a specific controller is generally installed therein. Accordingly, the atomizing control circuit of this embodiment is directly integrated in the controller of the transducer switch. As one aspect, the atomizing control circuit is capable of being integrated on an atomizing control circuit board which is disposed away from the transducer switch and is coupled with the transducer switch and the battery 30.

Referring to FIG. 7, as one aspect, the atomizing control switch 70 is exemplified by a traditional key switch. The key switch electrically connects the battery 30 through the atomizing control circuit board so as to control the atomizing control circuit by manipulating keys, whereby to realize power on and off of the atomizing device 40.

Please continuously refer to FIG. 7 and FIG. 8, a light emitting device 80 is disposed on one end of the main rod body 10 far away from the suction nozzle 20. The light emitting device 80 functions as an operation indicator light for the electronic cigarettes 100, and comprises a light emitting unit 81 electrically connecting the battery 30 and a light cap 82 which is located to cover outside the light emitting unit 81.

It is understandable that the electronic cigarette 100 of the present invention is not limited by the above-mentioned two embodiments as shown in FIG. 7 and FIG. 8. Each technical feature disclosed in each of the embodiments may be combined with each other to create a new embodiment.

Figure 9:
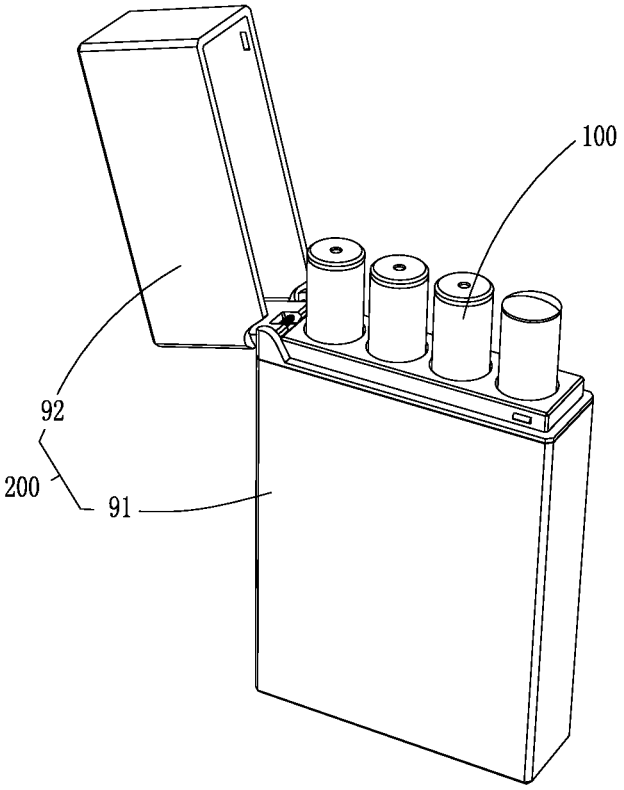
FIG. 9 is a perspective view of an electronic cigarette device of the present invention.

As shown in FIG. 9, the plurality of electronic cigarettes 100 are generally placed in the electronic cigarette case 200. The electronic cigarette case 200 comprises a bottom case 91 for storing the plurality of electronic cigarettes 100, and a case cover 92 for covering on the bottom case 91. The bottom case 91 has a rectangular case structure; certainly, a shape of the bottom case 91 is not limited by rectangular, and can be round, oval, or polygonal, etc, as long as the case cover 92 matches the bottom case 91.

It is understood that the invention may be embodied in other forms within the scope of the claims. Thus the present examples and embodiments are to be considered in all respects as illustrative, and not restrictive, of the invention defined by the claims.

What is claimed is:

1. An electronic cigarette atomizing device, comprising an atomizing cup having a liquid storing portion, and an atomizer disposed in the atomizing cup and abutting against the liquid storing portion so as to atomize a cigarette liquid, the atomizer comprising an atomizing rod and an electric heating filament wrapped around the atomizing rod, wherein the atomizing rod is made of a non-glass fiber, high-temperature resistant and insulating material, and comprises a base and at least two wrapping bars spaced apart from each other and axially disposed on outer sides of the base for facilitating wrapping of the electric heating filament, the atomizing rod axially forms an air guiding hole to penetrate the base and connect between the at least two wrapping bars for communicating with an inhaling air path.

2. The electronic cigarette atomizing device of claim 1, wherein the at least two wrapping bars extend radially from an axle center of the atomizing rod to form protruding teeth.

3. The electronic cigarette atomizing device of claim 2, wherein the air guiding hole passes through the base and extends to an appropriate height relative to the at least two wrapping bars.

4. The electronic cigarette atomizing device of claim 1, wherein the at least two wrapping bars are evenly arranged about an axle center of the atomizing rod along a periphery of the base.

5. The electronic cigarette atomizing device of claim 1, wherein the at least two wrapping bars are integrally formed with the base.

6. The electronic cigarette atomizing device of claim 1, wherein the atomizing rod is axially disposed in the atomizing cup with outer walls of the atomizing rod snug against inner walls of the liquid storing portion.

7. The electronic cigarette atomizing device of claim 6, wherein the atomizing cup further comprises an atomizing base for sealingly securing the liquid storing portion, the atomizing base is formed with a positioning peg extending axially towards the air guiding hole of the atomizing rod at an appropriate height for mounting the atomizing rod, a middle of the atomizing base is formed with an air venting channel penetrating the atomizing base in an axial direction thereof, and threading holes are correspondingly formed in the atomizing base to allow the electric heating filament to pass through.

8. An electronic cigarette, comprises a main rod body, one end of the main rod body provided with a suction nozzle, another end thereof installed with a battery, an atomizing device being disposed in the main rod body adjacent to the suction nozzle and electrically connected with the battery, and wherein the atomizing device is the electronic cigarette atomizing device as claimed in claim 1.

9. The electronic cigarette of claim 8, wherein one end of the atomizing device adjacent to the suction nozzle is provided with a sealing ring, and a middle of the sealing ring is formed with a leading hole axially penetrating the sealing ring and communicating with the air guiding hole so as to allow the air path to communicate outside.

10. The electronic cigarette of claim 8, wherein one end of the atomizing device adjacent to the battery is installed with a connecting module for electrically connecting the atomizing device and the battery, the connecting module comprises a first electrode element designated as a first electrode of the atomizing device, and a second electrode element designated as a second electrode of the atomizing device, and the first and second electrode elements are engaged with each other through an insulating ring.

11. The electronic cigarette of claim 10, wherein two ends of the electric heating filament are electrically connected to the first and second electrode elements.

12. The electronic cigarette of claim 8, wherein the electronic cigarette further comprises an atomizing control unit electrically connecting with the battery for controlling power on or power off of the atomizing device, and the atomizing control unit comprises an atomizing control circuit and an atomizing control switch coupling with the atomizing controlling circuit.

13. The electronic cigarette of claim 12, wherein the atomizing control switch is a transducer switch.

14. The electronic cigarette of claim 8, wherein a light emitting device is disposed on one end of the electronic cigarette far away from the suction nozzle, and the light emitting device comprises a light emitting unit and a light cap located to cover outside the light emitting unit.

15. An electronic cigarette device, comprises an electronic cigarette case and at least two electronic cigarettes accommodated in the electronic cigarette case, wherein each of the at least two electronic cigarette is the electronic cigarette as claimed in claim 8.

16. The electronic cigarette of claim 12, wherein the atomizing control switch is a key switch.

* * * * *